US005595335A

United States Patent [19]

Borel

[11] Patent Number: 5,595,335

[45] Date of Patent: Jan. 21, 1997

[54] INFEED STATION FOR CONVERTING A CONTINUOUSLY MOVING WEB-LIKE SHEET INTO AN INTERMITTENTLY FED WEB-LIKE SHEET FOR A SUBSEQUENT PROCESSING STATION

[75] Inventor: Edouard Borel, Corcelles, Switzerland

[73] Assignee: Bobst SA, Lausanne, Switzerland

[21] Appl. No.: 424,055

[22] Filed: Apr. 19, 1995

[30] Foreign Application Priority Data

Apr. 25, 1994 [CH] Switzerland ..... 01267/94

[51] Int. Cl.[6] ..... B65H 20/04; B65H 20/24; B65H 23/192

[52] U.S. Cl. ..... 226/42; 226/113; 226/188

[58] Field of Search ..... 226/188, 113, 226/124, 148, 156, 42, 43

[56] References Cited

U.S. PATENT DOCUMENTS

| | | | |
|---|---|---|---|
| 2,678,173 | 5/1954 | Phelps | 226/113 |
| 3,051,031 | 8/1962 | Allander | 226/124 |
| 3,084,841 | 4/1963 | Hata et al. | 226/124 |
| 3,385,178 | 3/1968 | Zernov | 226/124 |
| 3,419,204 | 12/1968 | Williamson | 226/124 |
| 3,606,124 | 9/1971 | Ott | 226/113 |
| 3,730,613 | 5/1973 | Neff | 226/113 |
| 3,804,637 | 4/1974 | Rejsa | 226/113 |
| 4,060,187 | 11/1977 | Grob | 226/8 |
| 4,244,504 | 1/1981 | Grob et al. . | |
| 4,778,093 | 10/1988 | Renold | 226/113 |
| 4,863,086 | 8/1989 | Armelin . | |

FOREIGN PATENT DOCUMENTS

| | | | |
|---|---|---|---|
| 0305230 | 3/1989 | European Pat. Off. . | |
| 2408538 | 6/1979 | France . | |
| 0136461 | 6/1987 | Japan | 226/188 |
| 0106258 | 5/1988 | Japan | 226/188 |
| 0106260 | 5/1988 | Japan | 226/188 |
| 0235243 | 9/1988 | Japan | 226/188 |
| 602462 | 7/1978 | Switzerland . | |

*Primary Examiner*—Daniel P. Stodola
*Assistant Examiner*—Matthew A. Kaness
*Attorney, Agent, or Firm*—Hill, Steadman & Simpson

[57] ABSTRACT

An infeed station comprises an eccentric roller fitted between two rotary plate around which a web-like sheet travels so as to have the sheet's speed transform from a constant inlet speed into a varying outlet speed according to the preconditions of the travel of the sheet in an operating cycle of the working station. The infeed station includes an infeed roller which guides the web-like sheet from the eccentric roller toward the working station, and this infeed roller is driven by an independent drive arrangement so that the peripheral speed follows the conditions similar to the outlet speed of the web-like sheet although remaining permanently at a higher rate.

6 Claims, 2 Drawing Sheets

INFEED STATION FOR CONVERTING A CONTINUOUSLY MOVING WEB-LIKE SHEET INTO AN INTERMITTENTLY FED WEB-LIKE SHEET FOR A SUBSEQUENT PROCESSING STATION

BACKGROUND OF THE INVENTION

The present invention is directed to a station for feeding a web-like matter or sheet, such as a cardboard web, into a station that processes it sequentially, for example a platen press.

Since a platen press is a machine that has to allow a web-like sheet to be temporarily stopped during a cutting operation, an accumulation of the web-like sheet in front of the platen press may occur due to a continuous infeed of the web. Machine designs have included an infeed station which would allow for cyclically monitoring of a formation of a loop of web-like sheet in order to reduce to a maximum the straining effect on this web at the moment when the loop touches a loop monitoring element, owing to the use of a device which carries the web-like sheet around a circumference of an eccentric roller fitted between two rotary plates. A device of this type is described in U.S. Pat. No. 4,060,187, whose disclosure is incorporated herein by reference thereto and which claims priority from a Swiss Application which resulted in Swiss Patent No. 602 462.

Due to the eccentric roller of the loop monitoring device, the constant speed VO of a running web at the inlet of the infeed station is modified with each operating cycle of the machine into an intermittent speed VIT, although the tension of the web is maintained constant. The evolution of the speed VIT throughout the operating cycle of the machine, which cycle is able to be divided into time units, though generally divided into angular position units of the main motor of the station, follows a predetermined and optimized curve with regard to the dynamic characteristics of the web-like sheet.

The web-like sheet, which comes out from the eccentric roller with a modulated speed is driven by a last, so-called infeed roller toward the platen. In order to avoid a collapse of the tension on the web-like sheet at a level of the infeed roller during the maximum running speed VIT, the peripheral speed VRO of this infeed roller is set at a rather high rate, i.e., higher than the maximum speed of the web travelling through the platen press. In other words, the infeed roller is driven permanently by the main motor as well as by a gear-train of the station at a constant rotational speed, which fact makes the peripheral speed of the roller always remain higher than the temporary running speed of the web-like sheet. This action converts into a permanent sliding of the web on the infeed roller, and the action of the frictional force existing between the contact surface of the web and roller is transformed into heat, which fact implies the necessity of an important cooling device for the infeed roller.

For a satisfactory function with standard cardboard, this device quickly reaches its limits when it comes to increasing the production speeds, hence the running speed, particularly with cardboard having a fine layer or coating on the back side, i.e., a polyethylene layer. Then, the heating action created by the frictional forces existing between the infeed roller and the cardboard will heat and partially scrape this fine layer. A plastic material forming the layer becomes pasty, and this tacky plastic material can be sound on the female creasing tools of the platen press. Moreover, inadmissible acceleration marks will appear on the board depending on the position of the infeed belts.

It is almost impossible to increase indefinitely the cooling effect of the water-cooling device of the infeed roller, since increased cooling causes external water condensation which will cause a sliding phenomenon between the web-like sheet and the roller. In addition, the machines may be used in areas which are already overheated, particularly during the summer season.

Thus, the acceleration being proportional to the speed square, it is easily understandable that an increase of 40% in the running speed of the web-like sheet will cause a duplication of the acceleration forces existing which normally have repercussions on the whole of the cinematic general drive chain of the machine, which fact quickly leads to an unrealistic overdimensioning of several of the drive elements.

SUMMARY OF THE INVENTION

The object of the present invention is to alleviate the above-mentioned problems by providing an infeed station allowing a higher operating speed, even for fine cardboard, although the entirety of the web-like sheet or the peripheral layer is preserved and the mechanical limits of the driving elements of the machine are respected.

These goals are achieved owing to an infeed station comprising an eccentric roller mounted between two rotary plates around which the web-like sheet travels so as to have the running speed of the web-like sheet converted from a constant inlet speed into an outlet speed which is variable and which evolves according to predetermined conditions in the course of the operating cycle of the station. The station has an infeed roller which guides the web-like sheet from the eccentric roller toward the platen press and the infeed roller is driven by an independent device or drive so that its peripheral speed follows conditions similar to the outlet speed of the web-like sheet in the platen press, although the peripheral speed remains permanently at a higher rate.

Owing to this driving device which is independent of the main motor of the station, the infeed roller is running at a peripheral speed which increases and decreases simultaneously with the intermittent speed of the web-like sheet in such a way that the difference between the two speeds is always held positive and even minimized at best. This particular driving of the infeed roller will convert into a remarkable reduction of the heat created from the rubbing, which action will only then preserve the fragile layer on the web-like sheet, or else with an identical cooling system, allows an increased running speed of the web-like sheet.

According to a preferred embodiment, the independent driving device of the infeed roller consists of a direct current electric motor complete with a reduction gear arrangement or unit limited to two pairs of gears.

The electric motor is connected to the shaft of the infeed roller by the two pairs of gears, with the first pair having a ratio of 20:36 and the second pair with a ratio of 15:38. The moment of the total inertia of the roller, of the two pairs of gears of the reduction gear unit and the motor is such that the level on the outlet axle of the motor is always less than 0.04 $kgm^2$.

Other advantages and features of the invention will be readily apparent from the following description of the preferred embodiments, the drawings and claims.

DESCRIPTION OF THE PREFERRED EMBODIMENTS

Figure 1:
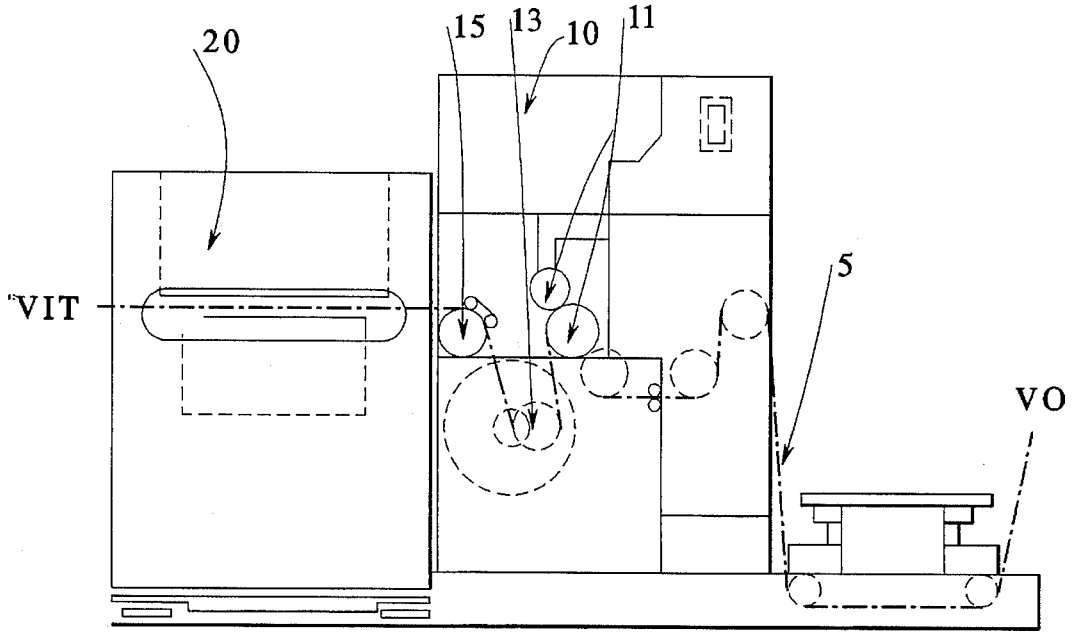
FIG. 1 is a schematic side view of an infeed station according to the present invention.

The principles of the present invention are particularly useful in an infeed station, generally indicated at 10, which is to receive, from upstream, a web-like sheet 5, which is travelling at a constant speed VO, and to deliver the web downstream at an intermittent speed VIT to a platen press 20 which is a working or processing station. In order to induce this speed variation, the web-like sheet 5 travels around an eccentric roller 13 with a low inertia, which is arranged in an eccentric way on two rotary lateral plates. With each rotation of the pairs of plates, the web-like sheet is to be made into a loop with a determined dimension and the outlet speed being almost non-existent during the formation of the loop.

A pair of rollers 11 apply a tension on the web-like sheet being drawn into the infeed station 10, whereas an infeed roller 15, which directs the web-like sheet toward the platen press 20, keeps the tension in the loop due to the frictional force as its peripheral speed VR remains all the time higher than the temporary speed VIT of the web-like sheet in the platen press 20.

Figure 2:
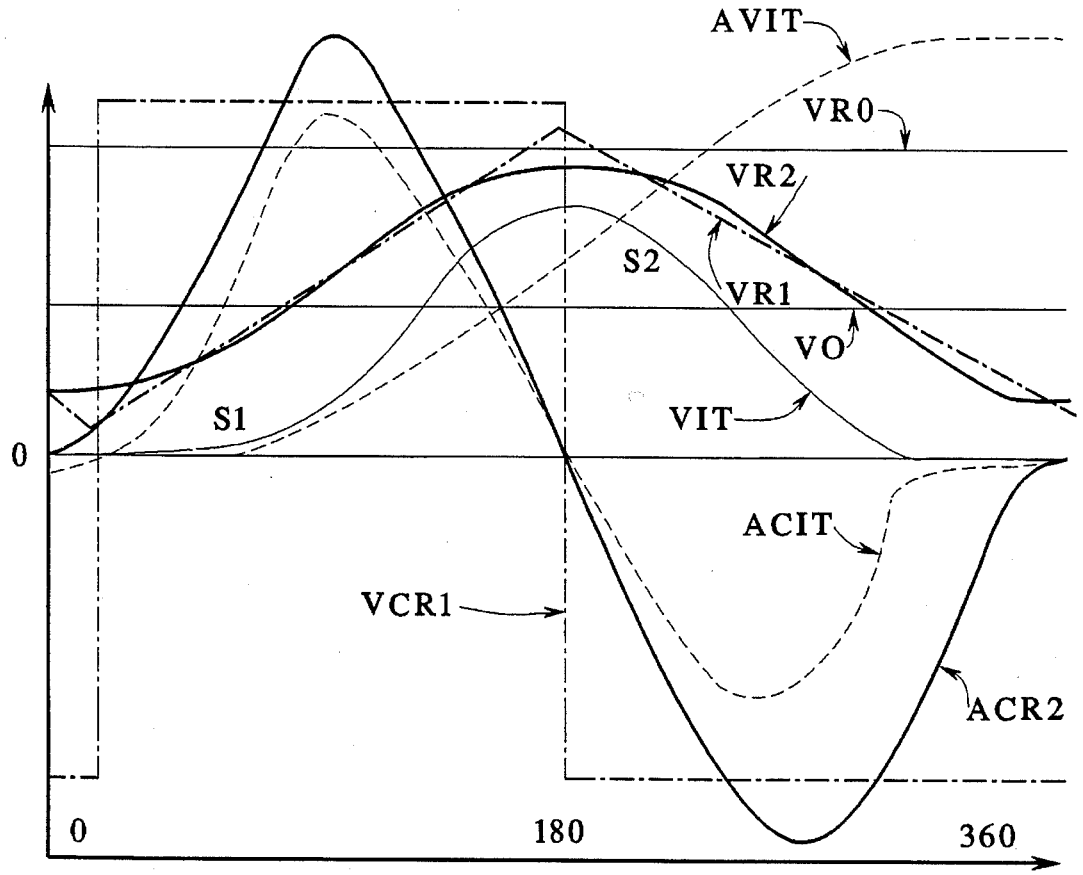
FIG. 2 is a schematic diagram of the forward motion, the speed and acceleration of the web-like sheet in relation to the two examples of peripheral speeds and accelerations of the infeed roller according to a cycle of the station stated in rotational degrees of the main drive motor.

As may be visible in FIG. 2, the progression AVIT of the web-like sheet at the outlet of the loop is no longer proportional to the general drive of the machine. During the descent of the eccentric roller 13 to form the loop in the sheet, the progression AVIT is almost non-existent, but the progression AVIT quickly grows or increases; and during the ascent of this roller 13 to decrease the size of the loop of the web-like sheet. The intermittent feed VIT of the web-like sheet follows a bell-shaped condition optimized according to the characteristics of the material of the web-like sheet and the conditions having an average rate in the cycle which corresponds to the arriving speed VO, which is actually in the order of 3.5 m/s. The curve ACIT represents the corresponding acceleration conditions which comprise an acceleration rate up to 190 $m/s^2$ and then a deceleration rate up to 250 $m/s^2$.

The intermittent speed VIT of the web-like sheet is able to reach a maximum rate of 8.5 m/s and a constant peripheral speed VRO of the upper infeed roller 15 of 9 m/s is imposed on the conventional machines. The surface or shaded area S1 shows the importance of the instant speed difference between a speed VRO and the speed VIT, which difference is converted in a proportional way into heat which must be dissipated.

Figure 3:
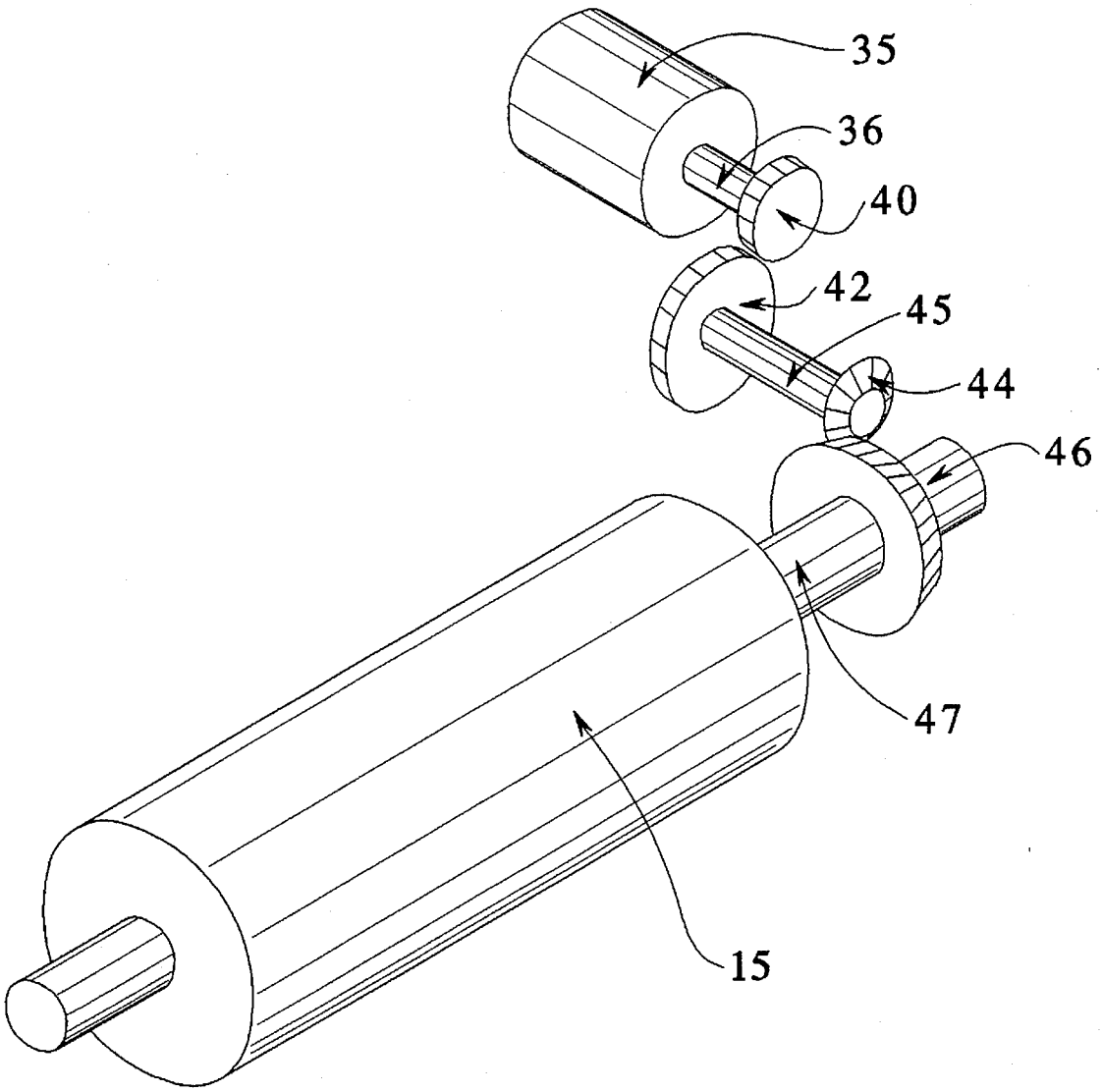
FIG. 3 is a schematic perspective view of an independent drive of the infeed roller.

According to the invention, and as shown in FIG. 3, the infeed roller 15 is driven by an independent direct current electric motor 35 through a reducing unit or means including a first pair of gears 40, 42 and a second pair of gears 44, 46. Due to this motor 35, the infeed roller 15 is no longer driven at a constant speed but according to the conditions VR1 or VR2.

According to the first condition, the speed VR1 of the infeed roller 15 is increased and decreased in a linear way from a rate of 2 m/s to a rate of 9.2 m/s, the acceleration and deceleration being shown by the curve ACR 1 being constant and applied by the motor.

According to a second condition or embodiment, the speed VR2 of the infeed roller 15 evolves according to a bell-shaped condition closer to the speed conditions VIT of the web-like sheet. Acceleration curve ACR2 is created by the motor and reaches a maximum.

The shaded area S2 represents the residual speed differences between the web-like sheet and the roller now reduced to an optimum rate in order to maintain a sufficient tension in the web-like sheet and to minimize the creation of heat.

The evaluation at the moment of inertia of the infeed roller 15 and of its driving device is achieved step-by-step, which, in a known feature, takes into account the moment of inertia of every component, i.e., the roller 15 with its rotational shaft 47, the driven bevelled wheel 46 attached to the shaft 47, the driving bevelled gear 44 on the shaft 45, the driving gear 42, the driving gear 40 on the outlet axle 36 of the motor 35. This operation taking into account the reduction ratio, for instance, of 15:38 at the point of the pair of gears 44, 46 and 20:36 at the point of the pair of gears 40, 42. The moment of total inertia brought back to the motor 35 can, in a typical way, be in the order of 0.03 $kgm^2$ and is always less than 0.04 $kgm^2$.

The necessary maximum torque to be furnished by the motor is equal to the multiplication of the moment of inertia by the maximum angular acceleration required.

For the adaptation on an existing machine, the load torque initially foreseen for the continuous drive of the infeed roller on the differential and the cinematic chain of the general drive of the machine may be compensated by an engine braking. The balance of energy is then achieved via the electric network.

The speed order according to the predetermined profile applied to the electric motor can be achieved either by a computer or by electrotechnic means, which are known features.

Although various minor modifications may be suggested by those versed in the art, it should be understood that I wish to embody within the scope of the patent granted hereon all such modifications as reasonably and properly come within the scope of my contribution to the art.

I claim:

1. In combination, an infeed station having an eccentric roller mounted for rotation between two rotary plates around which a web-like sheet travels so that the speed of the sheet entering the station is converted from a constant inlet speed into a variable outlet speed which is desired by an operating cycle of a working station to which the sheet is being supplied, said infeed station having an infeed roller for guiding the web-like sheet from the eccentric roller into the working station, the improvement comprising means for driving the infeed roller with a variable peripheral speed which is being synchronized with changes in the variable outlet speed of the web-like sheet passing through the working station although the variable peripheral speed of the feed roller remains permanently at a higher rate than the variable outlet speed of the web-like sheet.

2. In combination, an infeed station according to claim 1, wherein the means for driving the infeed roller consists of a direct current electrical motor coupled to the infeed roller through means tbr reducing the speed of rotation, which means for reducing includes two pairs of reduction gears.

3. In combination, an infeed station according to claim 2, wherein the electrical motor has an outlet axle connected to a shaft of the infeed roller by the means for reducing with one pair of the reduction gears having a ratio of 20:36 and the other pair of the reduction gears having a ratio of 15:38, and the moment of inertia of each of the infeed roller, the two pairs of the reduction gears, and the motor, which moment is applied to the outlet axle of the motor, is less than 0.04 $kgm^2$.

4. In combination, an infeed station having means for delivering a web-like sheet at a constant inlet speed, an eccentric roller mounted for rotation between two rotary plates around which the web-like sheet travels so that the constant inlet speed into the station is changed into a variable outlet speed which is desired by an operating cycle of a working station receiving the sheet from the infeed station, said infeed station having an infeed roller for guiding the web-like sheet from the eccentric roller into the working station, the improvements comprising means for driving the infeed roller with a varying peripheral speed which is synchronized with changes in the variable outlet speed of the web-like sheet passing through the working station with the varying peripheral speed of the infeed roller being greater than the variable outlet speed of the web-like sheet.

5. In combination, an infeed station according to claim 1, wherein the means for driving the infeed roller consists of a direct current electrical motor coupled through two pairs of reduction gears to a shaft of the infeed roller.

6. In combination, an infeed station according to claim 5, wherein one pair of the reduction gears has a ratio of 20:36 and the other pair of the reduction gears has a ratio of 15:38, and the moment of inertia of each of the infeed roller, the two pairs of reduction gears, and the motor, which moment of inertia is applied to an outlet axle of the motor, is less than 0.04 $kgm^2$.

* * * * *